US007073897B2

(12) United States Patent
Kubokawa

(10) Patent No.: US 7,073,897 B2
(45) Date of Patent: Jul. 11, 2006

(54) INK JET RECORDING APPARATUS OF MOBILE TYPE

(75) Inventor: Toru Kubokawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 10/714,074

(22) Filed: Nov. 13, 2003

(65) Prior Publication Data

US 2004/0095403 A1 May 20, 2004

(30) Foreign Application Priority Data

Nov. 15, 2002 (JP) ..... 2002-332326

(51) Int. Cl.
*B41J 2/175* (2006.01)

(52) U.S. Cl. ..... 347/86; 347/4; 429/12; 429/149

(58) Field of Classification Search ..... None
See application file for complete search history.

(56) References Cited

U.S. PATENT DOCUMENTS 6,375,314 B1 * 4/2002 Reed et al. ..... 347/85
2003/0165727 A1 * 9/2003 Priestnall et al. ..... 429/34
2004/0248003 A1 * 12/2004 Tsutsumi et al. ..... 429/209

* cited by examiner

*Primary Examiner*—Thinh Nguyen
*Assistant Examiner*—Brian J. Goldberg
(74) *Attorney, Agent, or Firm*—Morgan & Finnegan, L.L.P.

(57) ABSTRACT

The present invention provides a portable ink jet recording apparatus of mobile type in which the user does not pay attention to reservation of an electric power required for driving the recording apparatus. A detachable and exchangeable supplies container containing a recording material, recording fluid and fuel for a fuel cell is provided, and a hybrid cell comprised of a compact fuel cell and a secondary cell is used as a power supply system so that, when the ink jet recording apparatus is not driven, an electric power generated by the fuel cell is stored in the secondary cell.

7 Claims, 6 Drawing Sheets

INK JET RECORDING APPARATUS OF MOBILE TYPE

BACKGROUND OF THE INVENTION

1. Field of the Invention

The present invention relates to a portable ink jet recording apparatus of mobile type.

2. Related Background Art

In recent years, compactness and weight reduction of computers have been progressed and a chance for carrying a computer and using the computer outdoors or in a visiting place has been increased. Consequently, the demand in which a document or an image formed by the computer is outputted outdoors or in the visit plate has been produced, and, to this end, portable and compact recording apparatuses of mobile type have been proposed. Further, recently, so-called digital cameras in which image data is stored or recorded in a memory have been progressed and recording apparatuses in which data is directly sent from a digital camera to the recording apparatus from which an image is outputted have been developed. Among such recording apparatuses of mobile type, there are a recording apparatus in which, in addition to the information, an electric power required for the recording of the recording apparatus is supplied from a sender such as a note PC or a digital camera for sending the information such as the image to be outputted from the recording apparatus, and a recording apparatus designed to be driven by electric power supplying means such as a re-chargeable secondary cell or primary cell, which can be used outdoors having no AC power supply.

However, since the above-mentioned recording apparatus to which the electric power is supplied from outside of the recording apparatus utilizes a power supply of equipment at an electric power supplying side, the equipment at the electric power supplying side is subjected to a burden. That is to say, there arises a problem that a running time is shortened because the equipment supplies the electric power to the recording apparatus. To cope with this, it is considered that an additional secondary cell which was charged or an additional primary cell is prepared or an AC adaptor is prepared. In this case, however, there arises a problem that the portability becomes worse since the number of parts to be carried is increased and a weight to be carried is increased. This problem similarly occurs in a recording apparatus to which a cell is mounted. Further, in the recording apparatus, load fluctuation occurs in dependence upon a usage condition. Namely, although an ink jet recording apparatus having a plurality of discharge ports for discharging ink toward a recording material is frequently used as a portable recording apparatus of mobile type preferably in the viewpoint of low power consumption, nevertheless, when the ink is discharged from all of the discharge ports of the ink jet recording head, large electric current is required instantaneously. To cope with such large electric current, since a power supply having capacity corresponding to a maximum value of the electric current is required, a power supply circuit becomes larger, with the result that the entire apparatus becomes larger and cost is increased. This problem becomes more severe in a small apparatus used for a portable purpose and, if the power supply is constituted by a cell, load on the cell (battery) is increased in order to cope with the load fluctuation of the power supply by means of the cell, with the result that the service life of the cell, i.e. the usable time of the entire apparatus is decreased.

On the other hand, there has been proposed a technique in which a fuel cell is used as the cell used in the portable mobile equipment. In this fuel cell, hydrogen generated from fuel such as methanol is reacted with oxygen to generate electricity and water. Such a fuel cell has recently been watched as clean energy which does not contaminate environment. However, the cell becomes larger in order to permit the supplying the instantaneous large electric current, and much fuel must be loaded in order to increase the capacity of the cell and, since this leads to the bulkiness of the apparatus, the fuel cell is not so superior to the secondary cell.

As mentioned above, the user using the mobile type recording apparatus must always pay attention to the electric power to maintain the electric power required for the recording, and, nowadays, an environment for obtaining a desired image at a desired time is not arranged.

SUMMARY OF THE INVENTION

The present invention aims to solve the above-mentioned problems and an object of the present invention is to provide a portable recording apparatus of mobile type in which the user can output a desired image at a desired time without paying attention to a remaining amount of a cell.

To achieve the above object, the present invention provides an ink jet recording apparatus comprising recording means for forming an image by sticking recording fluid onto a recording material and storing means for storing and holding image information from which the image is formed by the recording means and wherein, for a portable compact ink jet recording apparatus having the recording material used by the recording means and an exchangeable supplies container for containing the recording fluid, a hybrid cell obtained by combining a compact fuel cell and a secondary cell is used as a power supply system and a supplies container containing fuel for the compact fuel cell is included in the exchangeable supplies container.

To achieve the above object, the present invention provides a cartridge detachable to a recording apparatus having recording means for recording on a sheet and a fuel cell, and containing the sheet to be supplied to said recording apparatus, said cartridge comprising a storing portion for storing a fuel to be supplied to said fuel cell.

To achieve the above object, the present invention provides a cartridge detachable to a recording apparatus having recording means for recording on a sheet and a fuel cell, and containing ink to be supplied to said recording apparatus, said cartridge comprising a storing portion for storing a fuel to be supplied to said fuel cell.

According to the ink jet recording apparatus of the present invention, when the user starts to perform the recording, since the recording material, recording fluid and electric power are supplied only by connecting the supplies container containing the recording material, recording fluid and fuel for the fuel cell to a main body of the recording apparatus, a recording apparatus in which, even when the recording apparatus is used outdoors having no AC power supply, the user does not prepared an additional cell for the usage of the recording apparatus and the user does not pay attention to disposal of the primary cell which is hard to be discarded can be provided.

DESCRIPTION OF THE PREFERRED EMBODIMENTS

Now, an embodiment of the present invention will be explained with reference to the accompanying drawings.

Figure 1:
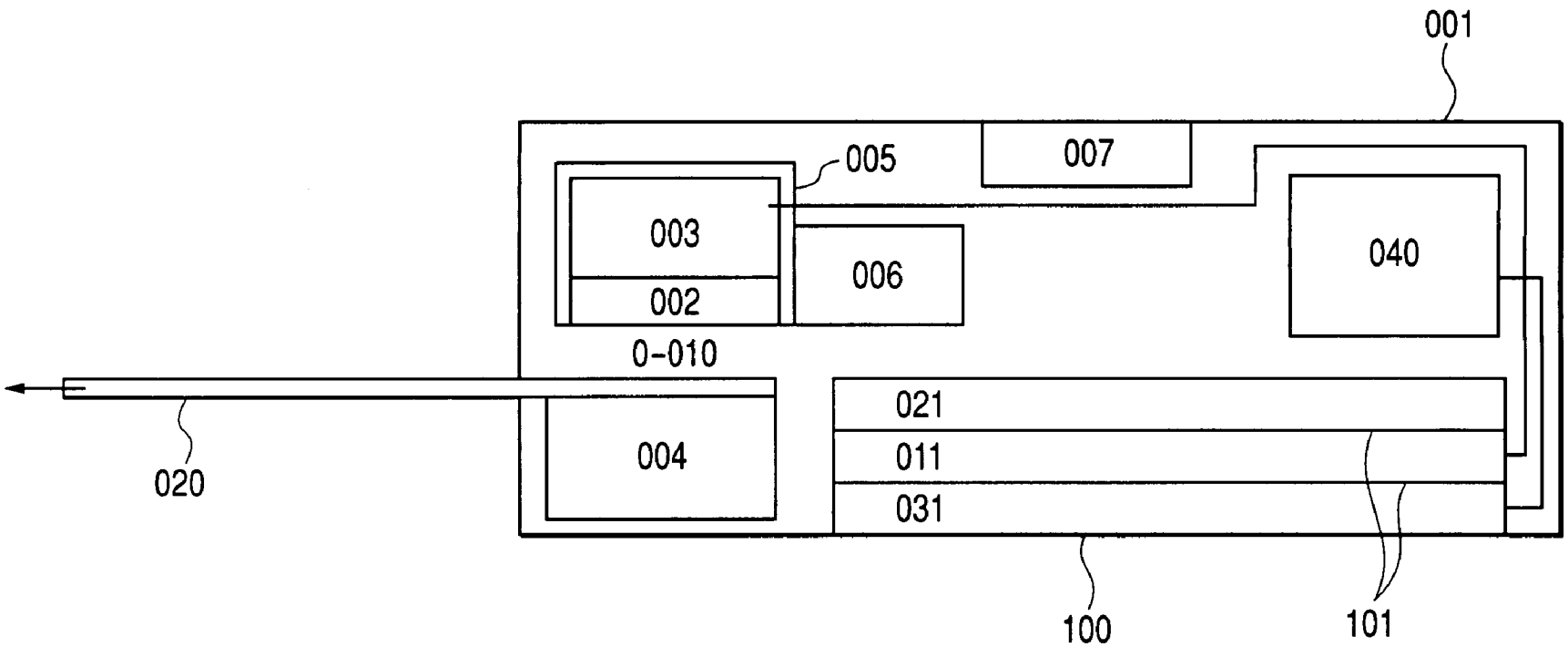
FIG. 1 is a schematic constructional view showing an ink jet recording apparatus according to an embodiment of the present invention.

FIG. 1 is a schematic constructional view showing an ink jet recording apparatus as an application example of the present invention. The ink jet recording apparatus 001 includes a print head 002 having a plurality of discharge ports for discharging recording fluid (ink) 010 to record an image on a recording material 020. The print head is connected to a holding mechanism 003 for holding the recording fluid, and the recording fluid holding mechanism 003 serves to supply the recording fluid 010 to the print head 002. The recording can be realized by a system in which the print head 001 and the recording material 020 are shifted or a system in which the recording material 020 alone is shifted. More concretely, in the former case, there are provided a conveying mechanism 004 for conveying the recording material 020, and a carriage shifting mechanism 006 for reciprocally shifting a carriage 005 constituted by integrating the print head 002 and the recording fluid holding mechanism 003 in a direction substantially perpendicular to a conveying direction for the recording material 020 in accordance with a size of the recording material 020; whereas, in the latter case, only the recording material conveying mechanism 004 is provided and the print head is a line printer head (not shown) permitting the recording in a width-wise direction of the recording material. Hereinafter, the print head 002, the carriage shifting mechanism 006 and the recording material conveying mechanism are generically referred to as a driving portion 200 of the ink jet recording apparatus. An electric power for driving the driving portion 200 is supplied from a power supply circuit portion 040. Further, the ink jet recording apparatus includes an interface 007 for receiving image information to be outputted by the ink jet recording apparatus from an external device. Further, the ink jet recording apparatus includes a detachable supply cartridge 100. In the supply cartridge 100, recording fluid 011, recording materials 021 and fuel 031 for a fuel cell are contained and are isolated from each other by partition walls 101. Further, the supply cartridge 100 is formed from flammable material which does not generate a toxic gas such as dioxin when burned. When the supply cartridge 100 is mounted to the ink jet recording apparatus 001, the recording fluid 011 in the supply cartridge is connected to the recording fluid holding mechanism 003 of the ink jet recording apparatus so that the recording fluid 011 in the supply cartridge can be supplied to the recording fluid holding mechanism 003, and the recording material 021 in the supply cartridge can be conveyed to a recordable position within the ink jet recording apparatus, and the fuel 031 for the fuel cell in the supply cartridge is connected to a fuel cell 041 in the power supply circuit portion 040 of the ink jet recording apparatus so that the fuel 031 for the fuel cell in the supply cartridge can be supplied to the fuel cell. Incidentally, regarding the contents contained in the supply cartridge, the recording fluid and the fuel for the fuel cell may be contained and the recording material may be inserted by the user when the image is recorded on the recording material by the ink jet recording apparatus.

Figure 2:
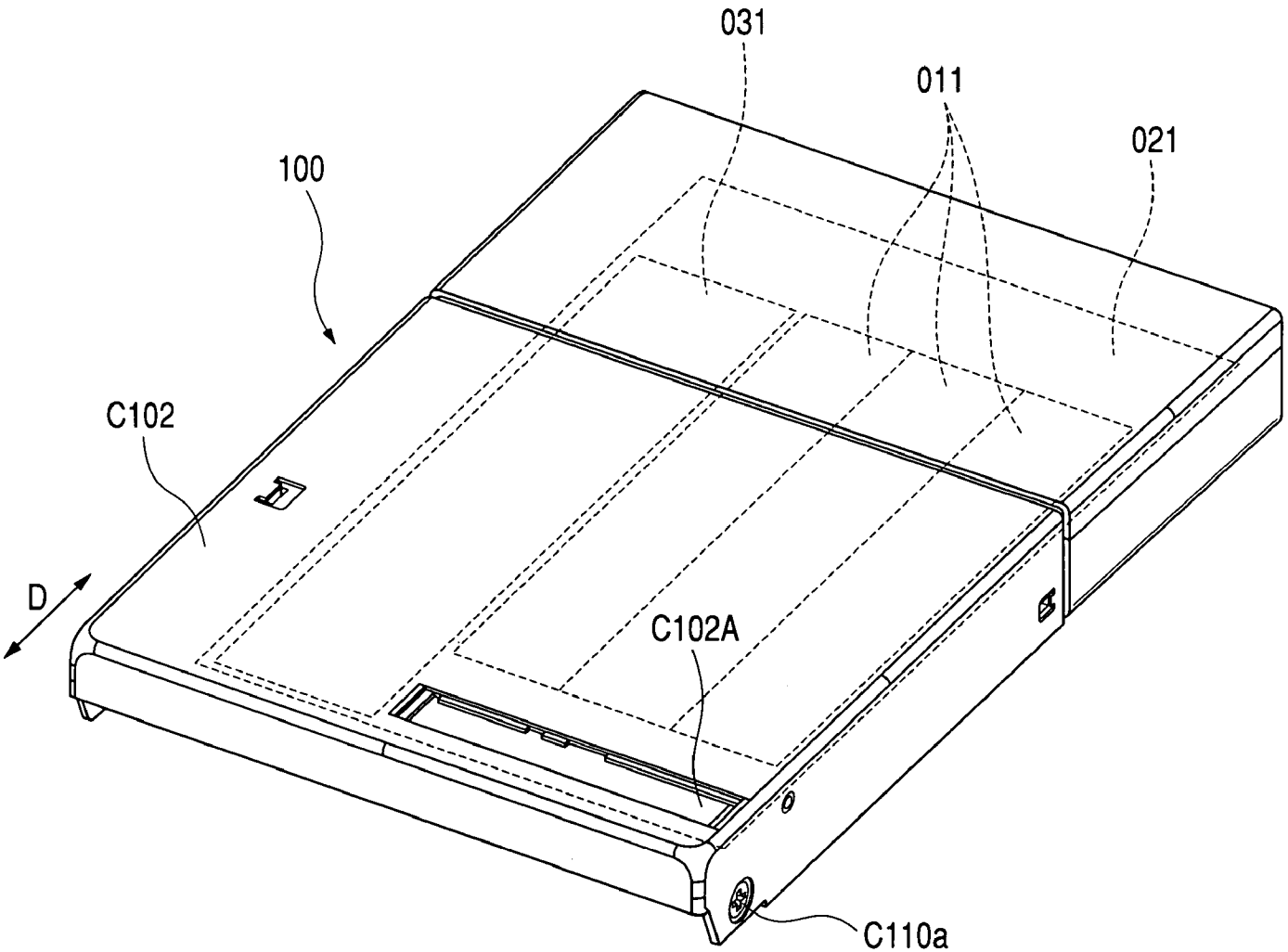
FIG. 2 is a perspective view of a supply cartridge according to the embodiment of the present invention.

FIG. 2 shows the supply cartridge 100.

Figure 3:
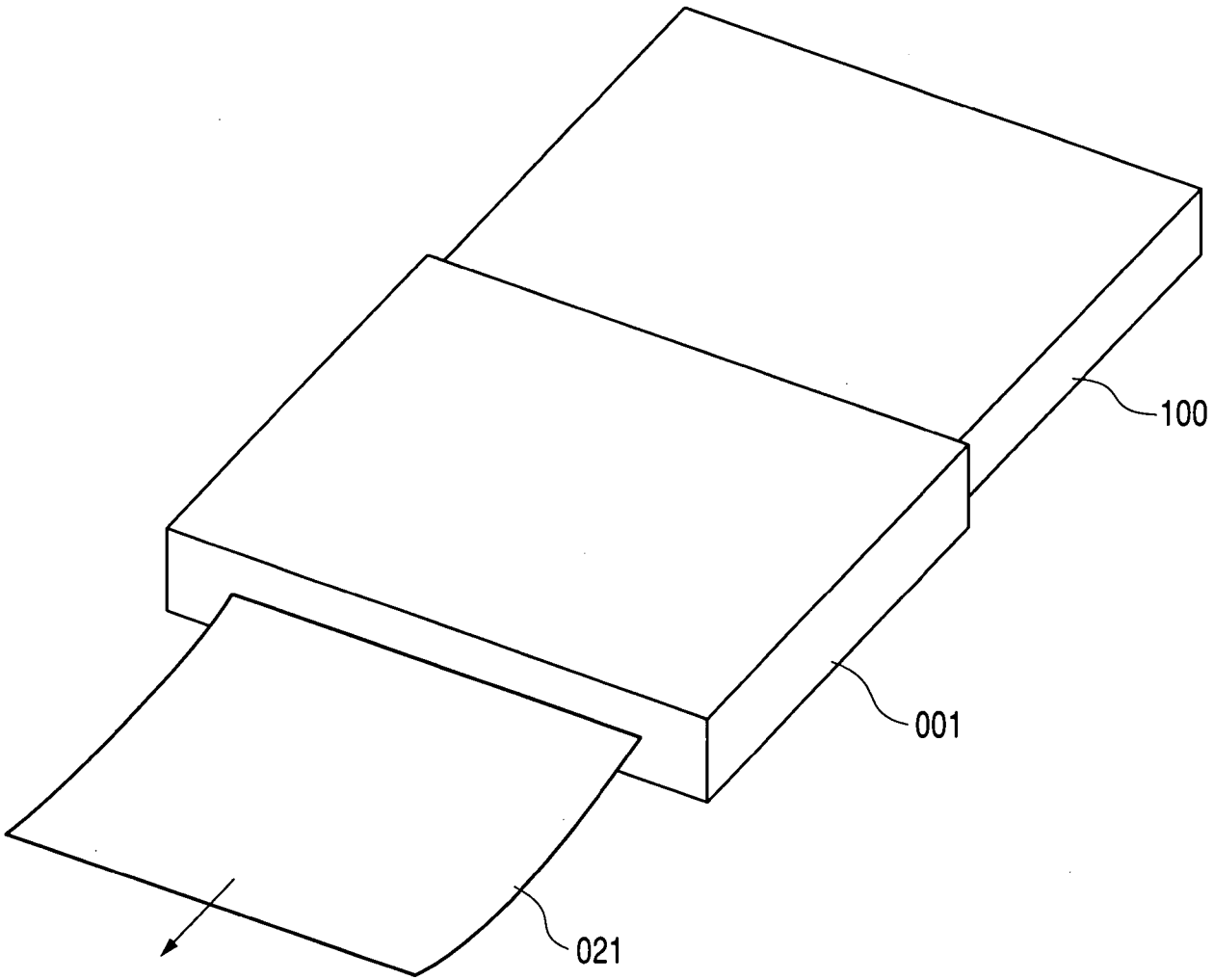
FIG. 3 is a perspective view of an ink jet recording apparatus according to the embodiment of the present invention.

The supply cartridge 100 is connected to the ink jet recording apparatus 001 as shown in FIG. 3, so that the contained recording material 021 is sent into the recording apparatus 001 by means of feeding means which will be described later and, after the recording, the recording material is discharged in a direction shown by the arrow. D showes an attaching and detaching direction of the supply cartridge 100.

The supply cartridge 100 includes therein ink packs 011 and the recording material 021. Further, a fuel container 031 containing the fuel for the fuel cell is contained in the supply cartridge 100.

The supply cartridge has an ink connector and a fuel connector which serve to send the inks in the ink packs 011 and the fuel in the fuel container 031 to the recording apparatus 001, respectively. When the supply cartridge 100 is mounted to the recording apparatus 001, the connectors are connected to an ink connector and a fuel connector of the recording apparatus, respectively, thereby sending the ink and the fuel.

Next, the ink jet recording apparatus will be explained in more detail.

Figure 4:
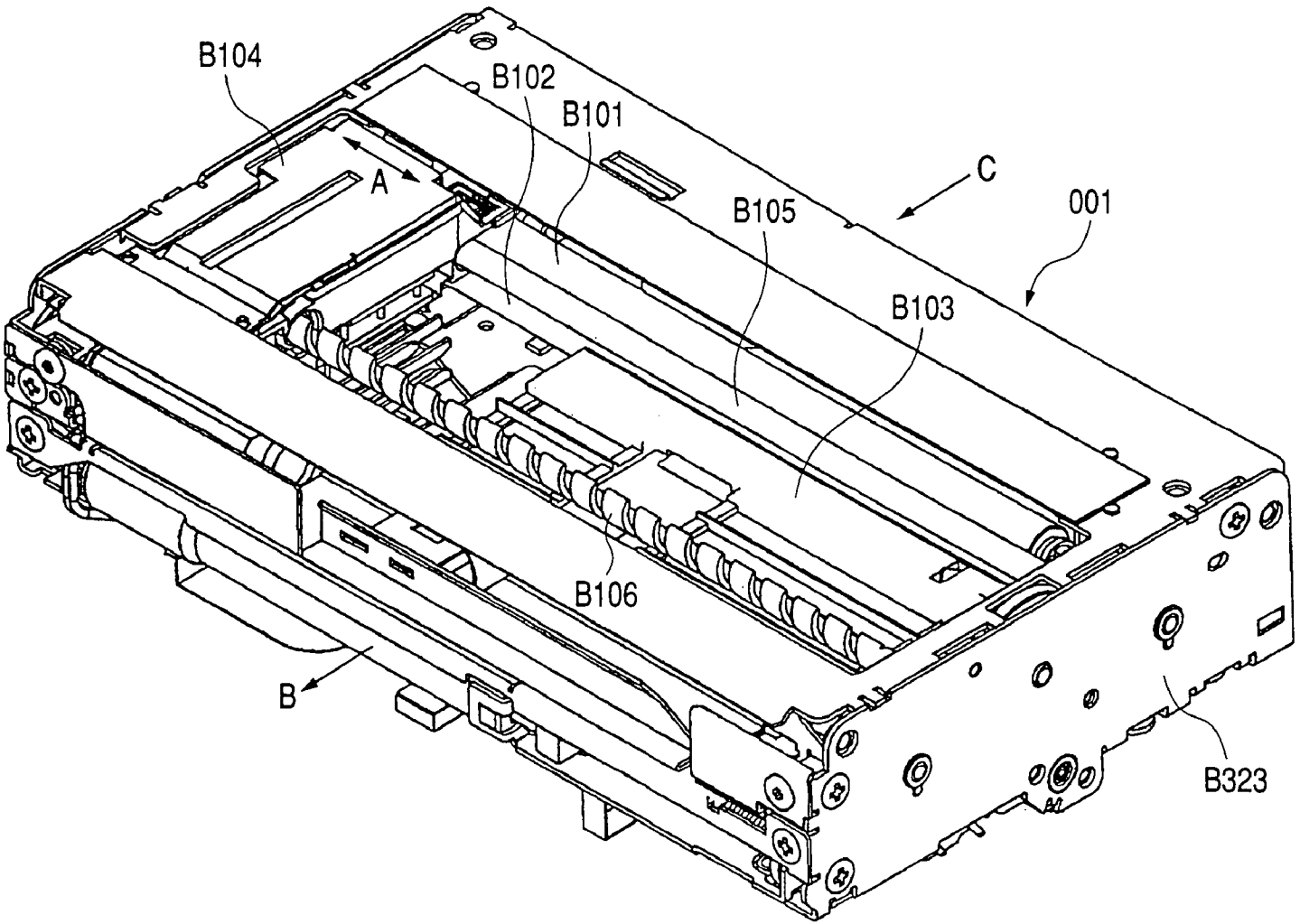
FIG. 4 is a perspective view showing the entire construction of the ink jet recording apparatus.

FIG. 4 is a perspective view of the entire ink jet recording apparatus 100.

B323 shows a frame of the ink jet recording apparatus. The recording material 021 contained in the supply cartridge 100 is pinched between an LF roller B101 and an LF pinch roller B102 and is conveyed in a sub scanning direction shown by the arrow B on a platen B103. A carriage B104 is reciprocally shifted in a main scanning direction shown by the arrow A along a guide B105 and a lead screw B106. An ink jet recording head (not shown) capable of discharging Y (yellow), M (magenta), and C (cyan) inks and sub tanks for containing the inks to be supplied to the recording head are mounted to the carriage B104. When the carriage B104 is shifted to a home position shown in FIG. 4, the inks are supplied from the ink packs 011 in the supply cartridge 100 to the sub tanks.

While the carriage B104 is being shifted in the main scanning direction A together with the recording head, by discharging the inks from the ink discharge ports of the recording head in response to image signals, a one-line image is recorded on the recording material on the platen B103. By repeating the one-line recording performed by means of the recording head and a predetermined amount conveying movement of the recording material in the sub scanning direction performed by a recording material conveying system which will be described later, a desired image is formed on the recording material.

Figure 5:
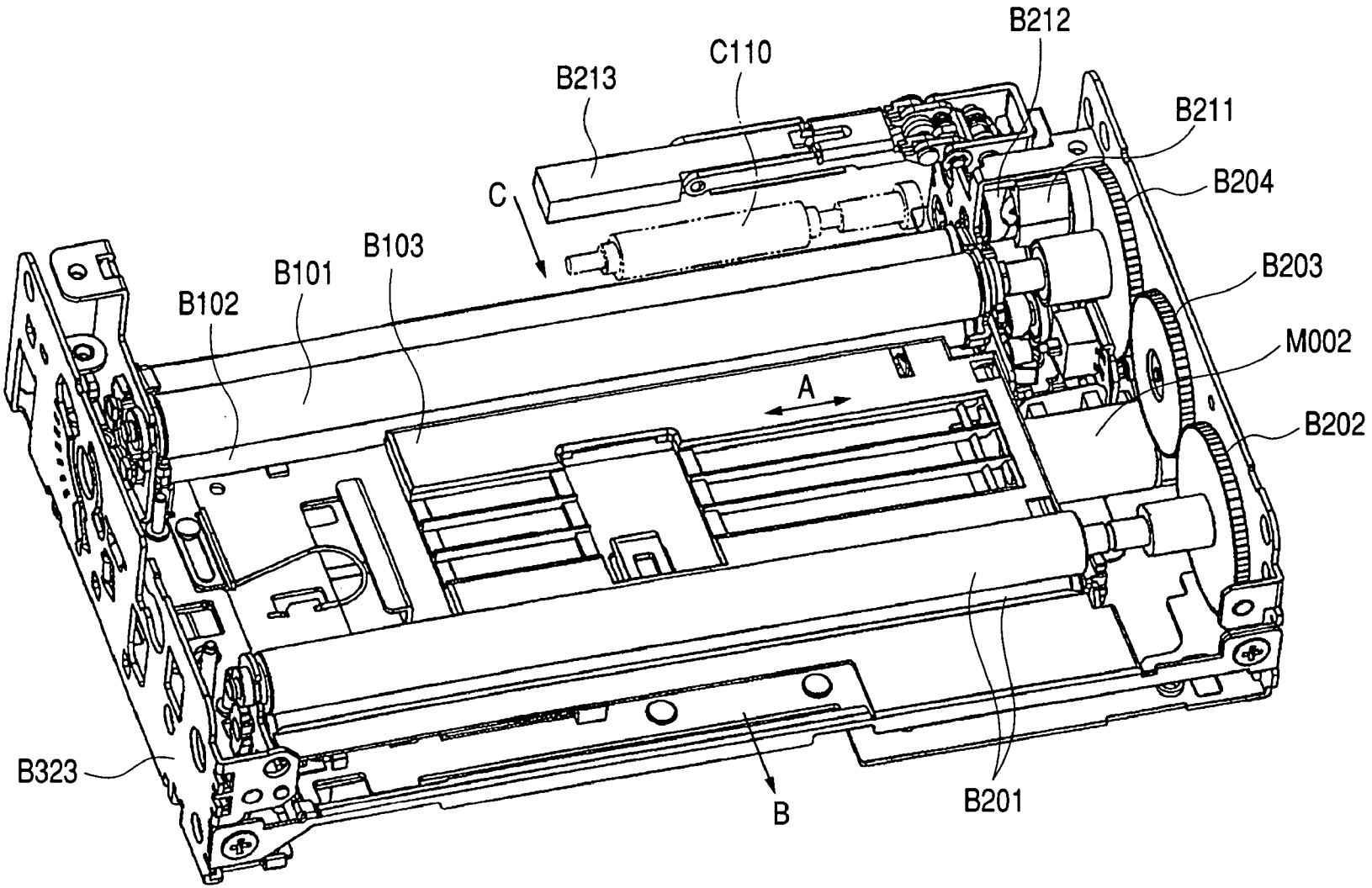
FIG. 5 is a perspective view showing a constructional part of a print medium conveying system of the recording apparatus.

FIG. 5 is a perspective view showing a constructional portion of the recording material (print medium) conveying system of the recording apparatus 001. In FIG. 5, a pair of discharge rollers B201 is shown. One of the discharge rollers B201 (upper discharge roller in FIG. 5) is driven by a conveying motor M002 via a discharge roller gear B202 and a relay gear B203. Similarly, the LF roller B101 is driven by the conveying motor M002 via an Lf roller gear B204 and the relay gear B203. The discharge rollers B201 and the LF roller B101 convey a print medium (recording material) 021 in the sub scanning direction B by a normal rotation of the conveying motor M002.

On the other hand, when the conveying motor M002 is rotated in a reverse direction, a pressure plate head B213 and a lock mechanism (not shown) are driven via a switching slider B211 and a switching cam B212 and a driving force is transmitted to a conveying roller C110 of the supply cartridge 100. That is to say, the pressure plate head B213 is passed through a window C102A (refer to FIG. 2) of a shutter C102 of the supply cartridge 100 by the driving force during the reverse rotation of the conveying motor M002, thereby urging print media 021 stacked within the supply cartridge 100 downwardly in FIG. 2. As a result, the lowermost (in FIG. 2) print medium 021 is urged against the conveying roller C110 of the supply cartridge 100. Further, the lock mechanism (not shown) locks the supply cartridge 100 with respect to a main body 001 of the recording apparatus by the driving force during the reverse rotation of the conveying motor M002, thereby inhibiting the dismounting of the supply cartridge 100. Further, when the conveying roller C110 of the supply cartridge 100 receives the driving force during the reverse rotation of the conveying motor M002 via a connecting portion C110*a*, the roller conveys the lowermost (FIG. 2) print medium 021 toward a direction shown by the arrow C.

In this way, when the conveying motor M002 is rotated in the reverse direction, the single print medium 021 is picked up from the supply cartridge 100 in the direction C, and, thereafter, when the conveying motor M002 is rotated in the normal direction, the print medium 021 is conveyed in the direction B.

Figure 6:
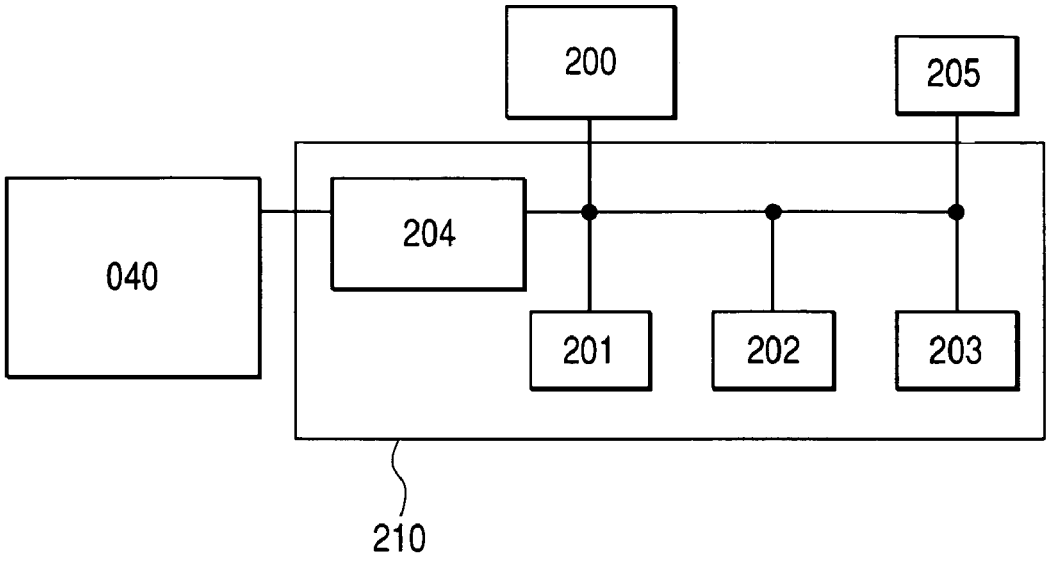
FIG. 6 is a block diagram showing an electric arrangement of an ink jet recording apparatus of mobile type according to an embodiment of the present invention.

Next, an electrical arrangement of the ink jet recording apparatus of mobile type according to the illustrated embodiment will be explained. FIG. 6 is a block diagram showing the electrical arrangement of the ink jet recording apparatus of mobile type according to the illustrated embodiment. In FIG. 6, a ROM 202 storing control program for controlling various function blocks in accordance with predetermined program, a RAM 203 as storing means for storing and holding print data, the driving portion 200 of the ink jet recording apparatus, a power supply control portion 204 for controlling the power supply circuit portion and an interface control portion 205 are connected to a CPU 201 as control means. The interface control portion 205 serves to convert levels and timings of signals such as image information recorded by the ink jet recording apparatus to suit them to the processing of the ink jet recording apparatus. Although the type of the interface to be mounted to the ink jet recording apparatus is not particularly limited, in a case where an interface of radio type such as an IrDA or a BLUETOOTH is used, an additional part such as a connection cable is not required to be carried. Of course, a centronics interface or a USB interface or an IEEE 1394 interface that requires the connection cable may be used. The CPU 201, ROM 202, RAM 203 and power supply control portion 204 are mounted on a control substrate 210. As another aspect of the electrical arrangement, an arrangement in which a RAM is not provided and the printing is performed directly from a signal from a device at a host side of the ink jet recording apparatus or an arrangement in which the ink jet recording apparatus is directly connected to the device at the host side of the ink jet recording apparatus via contacts and the like to avoid any interface may be used.

Figure 7:
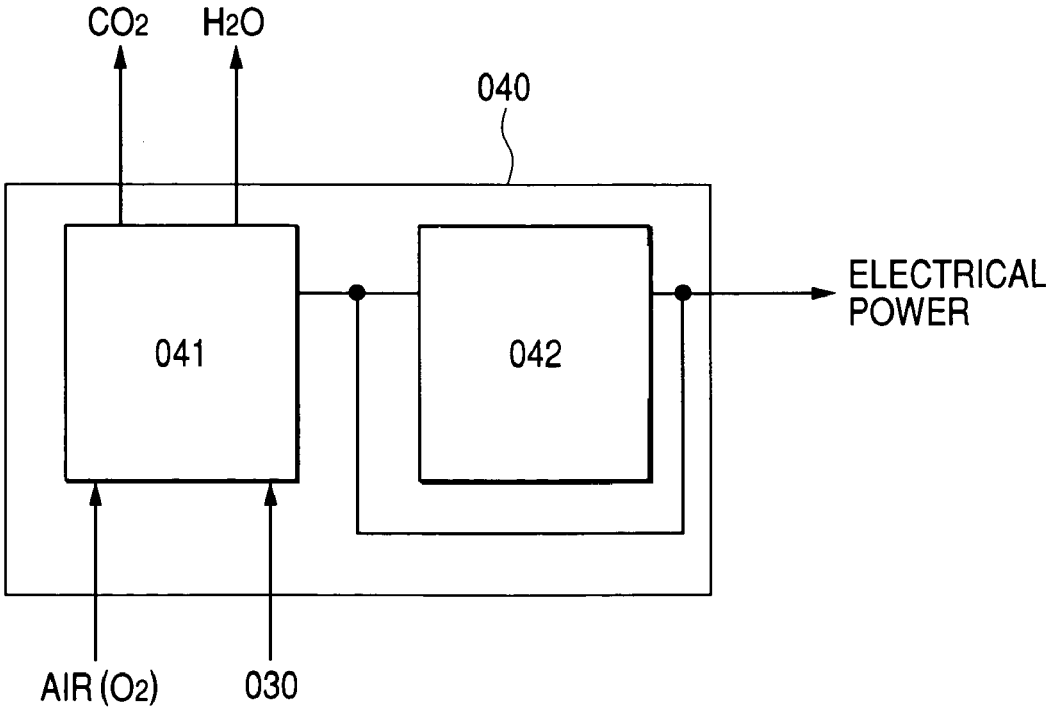
FIG. 7 is a schematic constructional view showing a power supply circuit portion of the ink jet recording apparatus.

FIG. 7 is a schematic constructional view showing a power supply circuit portion 040 of the ink jet recording apparatus as an application example of the present invention. The power supply circuit is powered by a hybrid cell comprising a compact fuel cell 041 and a secondary cell 042. The secondary cell 042 is designed so that it can also be charged by an AC power supply (not shown). That is to say, in a case where the recording apparatus is used at a visit place, if the AC power supply can be used, the ink jet recording apparatus is driven by the AC power supply and the secondary cell can be charged. When the fuel 031 for the fuel cell is supplied from the supply cartridge 100, the fuel cell 041 starts to generate electricity, with the result that the electric power can be supplied to the driving portion 200 of the ink jet recording apparatus and the secondary cell can be charged. When the recording apparatus starts the recording, since large electric current may be required instantaneously, the recording is performed by utilizing the electric power stored in the secondary cell 042 to reserve the peak electric current. In a case where the supply cartridge 100 is mounted and the recording apparatus does not perform the recording, while the fuel 030 is being consumed, the electric power generated by the fuel cell 041 is stored in the secondary cell 042. Since the secondary cell has capacity and performance capable of maintaining the electric power required for performing the recording on the recording materials in the supply cartridge, if the fuel 031 stored in the supply cartridge is used up, the recording can be performed by utilizing the electric power of the secondary cell. Incidentally, when the ink jet recording apparatus utilizes the AC power supply, generation of electric power of the fuel cell may be stopped. As an example of the fuel cell, there is a direct methanol cell (DMFC). Since this fuel cell does not require a reforming device for picking-up hydrogen from methanol, complexity of the system is reduced and, thus, the weight and volume of the fuel cell system can be reduced. The fuel is mixture of water and methanol that has higher convenience and safety than those of gasoline, pressurized hydrogen or hydride. Oxygen in air is used in a chemical reaction required for generating electricity. In this case, after the chemical reaction, since only $CO_2$ and $H_2O$ are discharged, toxic gases such as CO and NOx are not discharged. Normally, $H_2O$ is discharged as vapor or steam, a collection tank is not required. In addition, the discharged $H_2O$ is advantageous for the ink jet recording apparatus for the following reason. Normally, water is used as solvent for the recording fluid, and since the water is volatile, if the recording fluid is not discharged from the discharge ports for a long term, the volatile component of the recording fluid is vaporized, so that the recording fluid becomes unsuitable for the recording. $H_2O$ discharged from the fuel cell has the effect for preventing vaporization of water from the discharge ports, thereby maintaining the recording fluid suitable for the recording of the ink jet recording apparatus. Further, as an advantage obtained by using DMFC in the ink jet recording apparatus, since the methanol as the fuel used has similar chemical property to glycol class as the solvent included in the recording fluid, when the recording fluid and the cell fuel are supplied from the integrated supply cartridge, since the material for containing the recording fluid can be used as the material for containing the fuel for the fuel cell, even in a case where the supply cartridge is designed contain the fuel for the fuel cell, increase in the manufacturing cost of the supply cartridge can be suppressed.

By designing so that the power supply is constituted by the hybrid cell comprising the fuel cell and the secondary cell and the supplies and the fuel for the fuel cell are contained in the detachable integrated cartridge, the power supply capable of coping with the instantaneous large electric current can be made compact, and, when the user starts the recording by driving the recording apparatus, since the recording fluid and the recording material which are required for the recording are supplied and the fuel required for the generation of electric power of the fuel cell is also supplied, the user can output the desired image without pay attention to the reservation of the power supply of the recording apparatus, and, since wastes of the fuel remaining after the generation of electric power are discharged as gas from the fuel cell, a recording apparatus in which the user's operation for the recording is simplified without generating wastes which is hard to be discarded can be provided.

What is claimed is:

1. An ink jet recording apparatus comprising:

recording means for forming an image by sticking recording fluid onto a recording material;

a hybrid cell comprised of a fuel cell and a secondary cell as a power supply system; and a detachable and exchangeable supplies container for containing the recording fluid used by said recording means, wherein said supplies container includes therein a storing portion for storing fuel for said fuel cell, and in a case where said supplies container is mounted to said ink jet recording apparatus, the fuel stored in said storing portion is supplied to said fuel cell and said fuel cell supplies electric power for driving said ink jet recording apparatus, and when said ink jet recording apparatus is not driven, said power supply system stores an electric power generated by said fuel cell into said secondary cell.

2. An ink jet recording apparatus according to claim 1, wherein said storing portion is a container integrally containing the recording fluid used by said recording means, the recording material and the fuel for said fuel cell.

3. An ink jet recording apparatus according to claim 1, wherein said secondary cell has a capacity capable of storing the electric power generated by said fuel cell using the fuel contained in said storing portion.

4. An ink jet recording apparatus according to claim 1, further comprising information transmitting means for receiving image information for image formation performed by said recording means from an external device, and wherein said information transmitting means are an interface of radio type.

5. An ink jet recording apparatus according to claim 1, wherein said fuel cell is a direct methanol fuel cell (DMFC).

6. A recording apparatus comprising:

a cartridge detachable to a main body of said recording apparatus and adapted to contain a sheet;

conveying means for conveying the sheet contained in said cartridge;

recording head holding means for holding a recording head for recording an image on the sheet conveyed by said conveying means;

a fuel cell for generating an electric power for operating said recording apparatus;

a secondary cell configured to supply the electric power to operate said recording apparatus; and a storing portion provided in said cartridge and adapted to store fuel for said fuel cell, wherein said secondary cell is further configured to store the electric power generated by said fuel cell as well as supplied from an AC power source.

7. A recording apparatus according to claim 6, wherein said fuel cell is a direct methanol fuel cell (DMFC).

* * * * *